US009115633B2

(12) United States Patent
Lee

(10) Patent No.: US 9,115,633 B2
(45) Date of Patent: Aug. 25, 2015

(54) COOLANT CIRCULATION SYSTEM FOR ENGINE

(71) Applicants: Hyundai Motor Company, Seoul (KR); Kia Motors Corporation, Seoul (KR)

(72) Inventor: Bong Sang Lee, Whasung-Si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 14/145,544

(22) Filed: Dec. 31, 2013

(65) Prior Publication Data

US 2014/0290600 A1 Oct. 2, 2014

(30) Foreign Application Priority Data

Mar. 26, 2013 (KR) ..... 10-2013-0032178

(51) Int. Cl.

| | |
|---|---|
| ***F01P 3/00*** | (2006.01) |
| ***F01P 3/02*** | (2006.01) |
| *F01P 3/20* | (2006.01) |
| *F01P 7/16* | (2006.01) |

(52) U.S. Cl.

CPC ... *F01P 3/02* (2013.01); *F01P 3/20* (2013.01); *F01P 7/165* (2013.01); *F01P 2003/028* (2013.01); *F01P 2060/02* (2013.01); *F01P 2060/04* (2013.01); *F01P 2060/08* (2013.01)

(58) Field of Classification Search

CPC ... F01P 7/165; F01P 2060/08; F01P 2060/02; F01P 3/20; F01P 2060/04

USPC ..... 123/41.29

See application file for complete search history.

(56) References Cited

U.S. PATENT DOCUMENTS

2011/0023797 A1 * 2/2011 Lenz et al. ..... 123/41.29

FOREIGN PATENT DOCUMENTS

| | | | |
|---|---|---|---|
| JP | 2010-209749 | A | 9/2010 |
| KR | 100177334 | B1 | 11/1998 |
| KR | 1020090100285 | A | 9/2009 |

* cited by examiner

*Primary Examiner* — Lindsay Low
*Assistant Examiner* — Charles Brauch
(74) *Attorney, Agent, or Firm* — Morgan, Lewis & Bockius LLP

(57) ABSTRACT

A coolant circulation system for an engine efficiently cools the engine to prevent the capacity of an electronic water pump from being excessively increased. The system includes: a water pump; a cylinder block; a cylinder head; an intake block water jacket formed on one side of the cylinder block; an exhaust block water jacket formed on another side of the cylinder block; an intake side chamber provided on one surface of the cylinder block in a length direction of the engine about which a plurality of cylinders are arranged in parallel; an exhaust side chamber provided on the other surface of the cylinder block; and a head water jacket formed in the cylinder head to allow the intake block water jacket and the exhaust block water jacket to communicate with each other and the intake side chamber and the exhaust side chamber to communicate with each other.

5 Claims, 2 Drawing Sheets

COOLANT CIRCULATION SYSTEM FOR ENGINE

CROSS-REFERENCE TO RELATED APPLICATION

The present application claims priority of Korean Patent Application Number 10-2013-0032178 filed Mar. 26, 2013, the entire contents of which application is incorporated herein for all purposes by this reference.

BACKGROUND OF INVENTION

1. Field of Invention

The present invention relates to a coolant circulation system for an engine, and more particularly, to a coolant circulation system for an engine in which a cross flow is implemented.

2. Description of Related Art

In general, circulation of a coolant for cooling an engine is performed through a water jacket. Further, the water jacket is formed in a cylinder block and a cylinder head so as to circulate the coolant primarily upward and downward of the engine.

However, when a cooling scheme of circulating the coolant upward and downward of the engine through the water jacket is used, a complicated shape of the water jacket acts as resistance to the flow of the coolant and several cylinders of the engine are not easily uniformly cooled, and as a result, cooling efficiency may be degraded.

In recent years, an electronic water pump (EWP) has been used to efficiently cool the engine. The capacity of the electronic water pump may depend on a required cooling level. That is, an electronic water pump having a large capacity may be used in order to increase cooling efficiency.

However, the electronic water pump having a large capacity increase the weight of a vehicle to thereby conflict with a purpose of the electronic water pump to improve fuel efficiency of the vehicle.

The information disclosed in this Background section is only for enhancement of understanding of the general background of the invention and should not be taken as an acknowledgement or any form of suggestion that this information forms the prior art already known to a person skilled in the art.

BRIEF SUMMARY

Various aspects of the present invention provide for a coolant circulation system for an engine having advantages of efficiently cooling the engine so as to prevent the capacity of an electronic water pump from being excessively increased.

Further, the present invention has been made in an effort to provide a coolant circulation system for an engine having advantages in which a cross flow of a coolant can be smoothly implemented.

Various aspects of the present invention provide for a coolant circulation system for an engine, including: a water pump supplying coolant to the engine; a cylinder block with a plurality of cylinders; a cylinder head coupled to the top of the cylinder block; an intake block water jacket formed on one side of the cylinder block based on the plurality of cylinders; an exhaust block water jacket formed on the other side of the cylinder block based on the plurality of cylinders; an intake side chamber provided on one surface of the cylinder block in the length direction of the engine in which the plurality of cylinders are arranged in parallel; an exhaust side chamber provided on the other surface of the cylinder block in the length direction of the engine in which the plurality of cylinders are arranged in parallel; and a head water jacket formed in the cylinder head to allow the intake block water jacket and the exhaust block water jacket to be in communication with each other and the intake side chamber and the exhaust side chamber to be in communication with each other.

The intake block water jacket, the exhaust block water jacket, the intake side chamber, and the exhaust side chamber may be formed so as for the coolant supplied to the engine to cool the engine while passing through the cylinder block, and the head water jacket may be formed so as for the coolant supplied to the engine to cool the engine while passing through the cylinder head.

The system may further include a radiator provided to cool the coolant that passes through the intake block water jacket, the exhaust block water jacket, the intake side chamber, the exhaust side chamber, and the head water jacket.

The coolant supplied to the engine may sequentially pass through the intake side chamber, the head water jacket, and the exhaust side chamber.

The coolant supplied to the engine may cool the cylinder block while circulating in the length direction of the engine along the intake side chamber and the exhaust side chamber.

The coolant supplied to the engine may sequentially pass through the intake block water jacket, the head water jacket, and the exhaust block water jacket.

The coolant supplied to the engine may cool the cylinder block and the cylinder head while circulating upward and downward of the engine along the intake block water jacket, the head water jacket, and the exhaust block water jacket.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
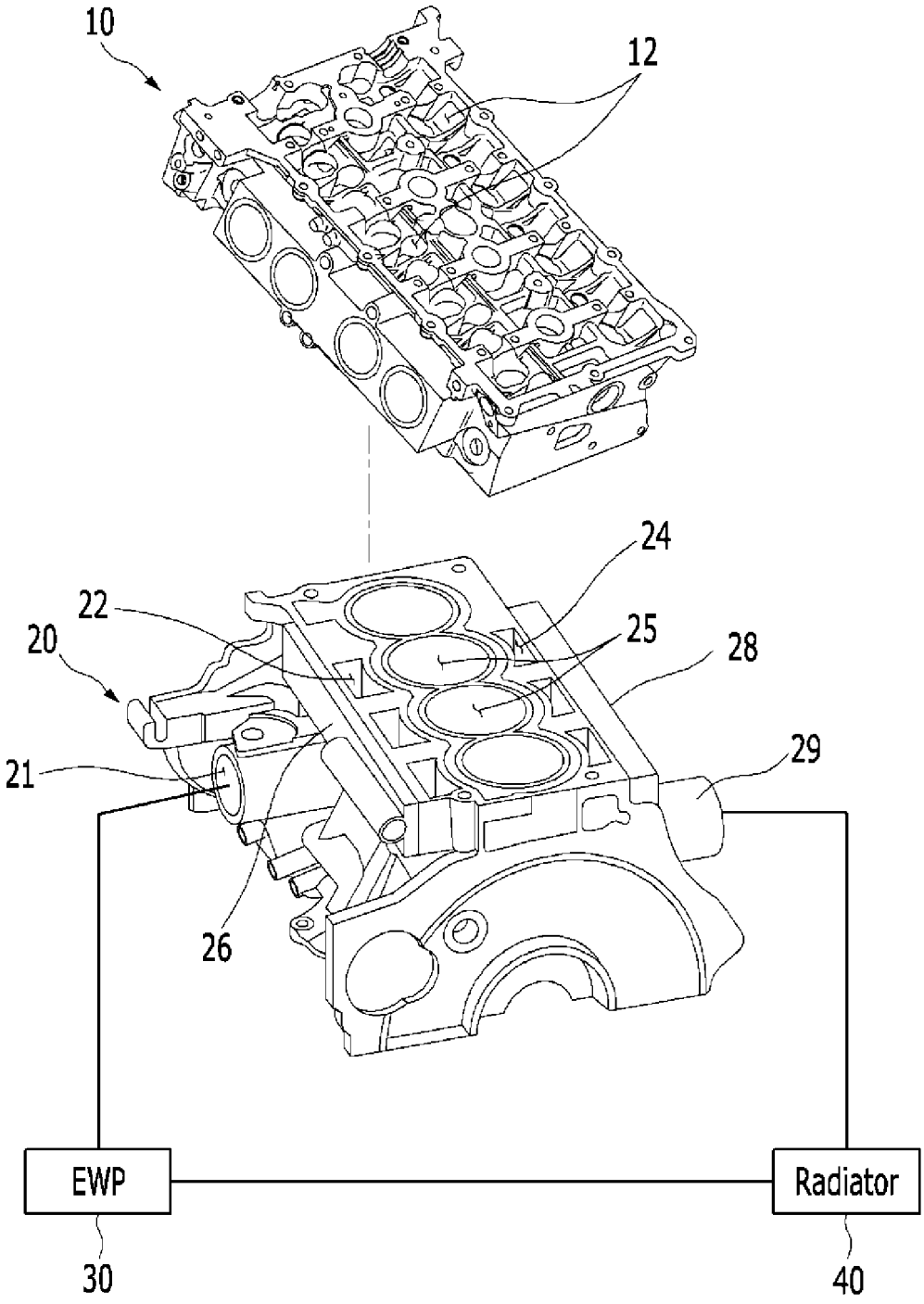
FIG. 1 is a schematic diagram of an exemplary coolant circulation system for an engine according to the present invention.

FIG. 1 is a schematic diagram of a coolant circulation system for an engine according to various embodiments of the present invention.

As illustrated in FIG. 1, a coolant circulation system for an engine according to various embodiments of the present invention includes a cylinder head 10, a cylinder block 20, an electronic water pump 30, a radiator 40, a head water jacket 12, an intake block water jacket 22, an exhaust block water jacket 24, an intake side chamber 26, an exhaust side chamber 28, a coolant inlet 21, and a coolant outlet 29.

The cylinder head 10 is installed on the top of the cylinder 25 as a head part of the engine. Further, the cylinder head 10 is a part that keeps air-tightness and water-tightness to obtain thermal energy. A combustion chamber (not illustrated) surrounded by the cylinder 25, a piston (not illustrated), and the cylinder head 10 is formed inside of the cylinder head 10. An ignition plug, an intake valve, and an exhaust valve are installed in the combustion chamber.

The cylinder block 20 as a part that becomes the center of the engine is placed below the cylinder head 10. Further, the plurality of pistons and cylinders 25 are incorporated in the cylinder block 20. Even though four cylinders 25 are placed in the cylinder block 20 in FIG. 1, it is not limited thereto.

A body of the engine is constituted by the cylinder block 20, the cylinder head 10, and a crankcase (not illustrated) placed below the cylinder block 20.

The electronic water pump 30 is a device that supplies the coolant to cool the engine. Further, the electronic water pump 30 as a water pump using electricity as power is used to enhance cooling efficiency of the engine. Furthermore, when the electronic water pump 30 is used, the engine may be rapidly warmed up and it is easy to selectively cool the engine by electric control.

The radiator 40 is a device for dissipating heat of the coolant in a water cooling engine into air. That is, the radiator 40 absorbs heat while passing through the cylinder block 20 and the cylinder head 10 to cool the coolant of which the temperature rises. The coolant of which the temperature rises is cooled through heat-exchange with air while passing through a heat dissipation plate of the radiator 40. Meanwhile, the radiator 40 is installed primarily at the front of a vehicle and has a structure to cool down the heat of the coolant by wind. Furthermore, the radiator 40 may be used to heat a room of the vehicle by using the coolant of which the temperature rises as a heat source.

Meanwhile, a passage of the coolant that connects the radiator 40 and the electronic water pump 30 is provided so as to supply the coolant that passes through the radiator 40 to the electronic water pump 30.

Since the cylinder head 10, the cylinder block 20, the electronic water pump 30, and the radiator 40 are apparent to persons who have general knowledge in the relevant technical field (hereinafter, those skilled in the art), a more detailed description will be omitted.

The water jacket represents the passage of the coolant installed around the plurality of cylinders 25. Further, the water jacket is formed in the cylinder block 20 and the cylinder head 10. Furthermore, the water jacket is an empty space formed by placing a core in a mold at the time of casting the cylinder block 20 and the cylinder head 10. Meanwhile, the coolant is circulated upward and downward of the engine through the water jacket to cool the cylinder 25 and the combustion chamber.

The head water jacket 12 is a water jacket that is formed in the cylinder head 10. Further, the head water jacket 12 may have a complicated shape to prevent interference with the ignition plug, the intake valve, and the exhaust valve that are placed in the cylinder head 10. The complicated shape of the head water jacket 12 acts as resistance to the circulation of the coolant and may degrade the cooling efficiency of the engine. Meanwhile, when in the engine, a part where the intake valve is installed is defined as an intake side and a part where the exhaust valve is installed is defined as an exhaust side, the head water jacket 12 is connected while crossing the intake side and the exhaust side.

The intake block water jacket 22 and the exhaust block water jacket 24 are block water jackets 22 and 24 formed in the cylinder block 20. Further, the intake block water jacket 22 is formed at the intake side of the cylinder block 20 based on the plurality of cylinders 25 and the exhaust block water jacket 24 is at the exhaust side of the cylinder block 20 based on the plurality of cylinders 25. Furthermore, the intake block water jacket 22 and the exhaust block water jacket 24 are in communication with the head water jacket 12 by combining the cylinder head 10 and the cylinder block 20.

The intake side chamber 26 and the exhaust side chamber 28 are provided on the lateral surface of the cylinder block 20. Further, the intake side chamber 26 and the exhaust side chamber 28 have a hollow shape so that the coolant flows therein. Furthermore, when a direction in which the plurality of cylinders 25 is arranged in parallel is defined as the length direction of the engine, the intake side chamber 26 and the exhaust side chamber 28 are mounted on the cylinder block 20 so as to circulate the coolant in the length direction of the engine. Even though the intake side chamber 26 and the exhaust side chamber 28 are independently formed to be coupled with the cylinder block 20 in FIG. 1, it is not limited thereto and the intake side chamber 26 and the exhaust side chamber 28 may be cast integrally with the cylinder block 20. One will appreciate that such integral components may be monolithically formed.

The intake side chamber 26 is mounted on the lateral surface of the cylinder block 20 at the intake side of the cylinder block 20 based on the plurality of cylinders 25 and the exhaust side chamber 28 is mounted on the lateral surface of the cylinder block 20 at the exhaust side of the cylinder block 20 based on the plurality of cylinders 25. Further, the intake side chamber 26 and the exhaust side chamber 28 are in communication with the head water jacket 12 by combining the cylinder head 10 and the cylinder block 20.

The coolant inlet 21 is a part through which the coolant flows into the engine so that the coolant is circulated through the head water jacket 12, the intake block water jacket 22, the exhaust block water jacket 24, the intake side chamber 26, and the exhaust side chamber 28

Therefore, the coolant inlet 21 may have a hollow pipe shape. The coolant inlet 21 may be formed in the cylinder block 20. The coolant inlet 21 may be formed on the lateral surface at the intake side of the cylinder block 20. One end of the coolant inlet 21 is in communication with the intake block water jacket 22 and the intake side chamber 26 and the other end is connected with the electronic water pump 30. That is, coolant pumped from the electronic water pump 30 flows into the intake block water jacket 22 and the intake side chamber 26 through the coolant inlet 21.

The coolant outlet 29 is a part through which the coolant of which the temperature rises while cooling the engine flows out of the engine. Therefore, the coolant outlet 29 may have the hollow pipe shape. The coolant outlet 29 may be formed in the cylinder block 20. The coolant outlet 29 may be formed on the lateral surface at the exhaust side of the cylinder block 20. One end of the coolant outlet 29 is in communication with the exhaust block water jacket 24 and the exhaust side chamber 28, and the other end is connected with the radiator 40. That is, the coolant is supplied to the radiator 40 through the coolant outlet 29 by passing through the exhaust block water jacket 24 and the exhaust side chamber 28.

Figure 2:
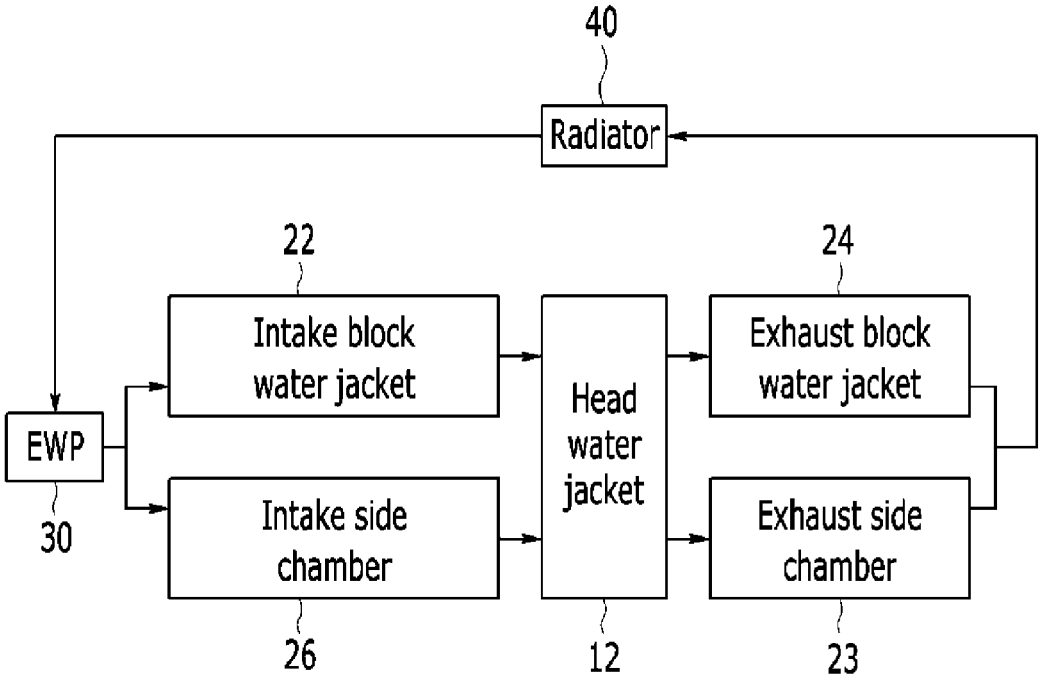
FIG. 2 is a block diagram illustrating circulation of a coolant through an exemplary coolant circulation system for an engine according to the present invention.

FIG. 2 is a block diagram illustrating circulation of a coolant through the coolant circulation system for an engine according to various embodiments of the present invention.

As illustrated in FIG. 2, the coolant pumped from the electronic water pump 30 is supplied to the intake block water jacket 22 and the intake side chamber 26 through the coolant inlet 21.

The coolant that passes through the intake block water jacket 22 and the intake side chamber 26 is supplied to the head water jacket 12.

The coolant supplied to the head water jacket 12 flows while crossing from the intake side to the exhaust side of the cylinder head 10, and as a result, the coolant that passes through the head water jacket 12 is supplied to the exhaust block water jacket 24 and the exhaust side chamber 28.

The coolant that passes through the exhaust block water jacket 24 and the exhaust side chamber 28 is supplied to the radiator 40 through the coolant outlet 29.

The coolant supplied to the radiator 40 is cooled via the radiator 40 and the cooled coolant is supplied to the electronic water pump 30.

Therefore, the coolant is repeatedly circulated in the constituent elements in sequence. In this case, the electronic water pump 30 is electrically controlled to selectively cool the engine. A cross flow in which the coolant is circulated in the length direction of the engine through the intake side chamber 26 and the exhaust side chamber 28 may be implemented. The cross flow of the coolant may improve the cooling efficiency of the engine and minimize the capacity of the electronic water pump 30 required to cool the engine.

As described above, according to various embodiments of the present invention, the cross flow of the coolant is smoothly implemented by the side chamber 26 and 28 to maximize the cooling efficiency. Further, the capacity of the electronic water pump is prevented from being increased to decrease the weight of the vehicle and improve the fuel efficiency.

For convenience in explanation and accurate definition in the appended claims, the terms front and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A coolant circulation system for an engine, comprising:

a water pump supplying coolant to the engine;

a cylinder block including a plurality of cylinders;

a cylinder head coupled to the top of the cylinder block;

an intake block water jacket formed on one side of the cylinder block based on the plurality of cylinders;

an exhaust block water jacket formed on another side of the cylinder block based on the plurality of cylinders;

an intake side chamber provided on one surface of the cylinder block in a length direction of the engine in which the plurality of cylinders are arranged in parallel;

an exhaust side chamber provided on another surface of the cylinder block in the length direction of the engine in which the plurality of cylinders are arranged in parallel; and a head water jacket formed in the cylinder head, wherein the intake block water jacket is disposed upstream of the head water jacket and the exhaust block water jacket is disposed downstream of the head water jacket to allow the intake block water jacket and the exhaust block water jacket to be in fluid-communication with each other through the head water jacket and, wherein the intake side chamber is disposed upstream of the head water jacket and the exhaust side chamber is disposed downstream of the head water jacket to allow the intake side chamber and the exhaust side chamber to be in fluid-communication with each other through the head water jacket;

wherein the intake block water jacket, the exhaust block water jacket, the intake side chamber, and the exhaust side chamber are formed for the coolant supplied to the engine to cool the engine while passing through the cylinder block; and the head water jacket is formed for the coolant supplied to the engine to cool the engine while passing through the cylinder head, wherein the intake block water jacket and the intake side chamber are separately formed to the cylinder block, and the exhaust block water jacket and the exhaust side chamber are separately formed to the cylinder block, and wherein the coolant supplied to the engine cools the cylinder block while circulating in the length direction of the engine along the intake side chamber and the exhaust side chamber.

2. The system of claim 1, further comprising:

a radiator provided to cool the coolant that passes through the intake block water jacket, the exhaust block water jacket, the intake side chamber, the exhaust side chamber, and the head water jacket.

3. The system of claim 1, wherein the coolant supplied to the engine sequentially passes through the intake side chamber, the head water jacket, and the exhaust side chamber.

4. The system of claim 1, wherein the coolant supplied to the engine sequentially passes through the intake block water jacket, the head water jacket, and the exhaust block water jacket.

5. The system of claim 1, wherein the coolant supplied to the engine cools the cylinder block and the cylinder head while circulating upward and downward of the engine along the intake block water jacket, the head water jacket, and the exhaust block water jacket.

* * * * *